US010619455B2

(12) United States Patent
Bridges et al.

(10) Patent No.: US 10,619,455 B2
(45) Date of Patent: Apr. 14, 2020

(54) SUBASSEMBLY FOR A BOTTOM HOLE ASSEMBLY OF A DRILL STRING WITH COMMUNICATIONS LINK

(71) Applicant: Enteq Upstream USA Inc., Houston, TX (US)

(72) Inventors: Andrew Bridges, Houston, TX (US); Raymond Garcia, Houston, TX (US)

(73) Assignee: Enteq Upstream USA Inc., Houston, TX (US)

( * ) Notice: Subject to any disclaimer, the term of this patent is extended or adjusted under 35 U.S.C. 154(b) by 48 days.

(21) Appl. No.: 15/895,234

(22) Filed: Feb. 13, 2018

(65) Prior Publication Data

US 2018/0230777 A1 Aug. 16, 2018

Related U.S. Application Data

(60) Provisional application No. 62/459,112, filed on Feb. 15, 2017.

(51) Int. Cl.

| | |
|---|---|
| ***E21B 47/01*** | (2012.01) |
| ***E21B 41/00*** | (2006.01) |
| ***E21B 47/12*** | (2012.01) |
| ***E21B 17/16*** | (2006.01) |

(Continued)

(52) U.S. Cl.

CPC ..... *E21B 41/0085* (2013.01); *E21B 17/16* (2013.01); *E21B 41/00* (2013.01); *E21B 47/01* (2013.01); *E21B 47/12* (2013.01); *E21B 47/124* (2013.01); *E21B 47/06* (2013.01); *E21B 49/00* (2013.01)

(58) Field of Classification Search

CPC ..... E21B 47/01; E21B 47/011; E21B 47/12; E21B 17/028; E21B 17/003

See application file for complete search history.

(56) References Cited

U.S. PATENT DOCUMENTS

| | | | | |
|---|---|---|---|---|
| 4,806,928 | A | 2/1989 | Veneruso | |
| 6,427,783 | B2 * | 8/2002 | Krueger | E21B 7/062 175/40 |

(Continued)

FOREIGN PATENT DOCUMENTS

| | | |
|---|---|---|
| WO | 2014080178 A2 | 5/2014 |
| WO | 2015192226 A1 | 12/2015 |

OTHER PUBLICATIONS

Intellectual Property Office, Search and Examination Report in GB1703392.9, dated Jun. 15, 2017.

(Continued)

*Primary Examiner* — Kenneth L Thompson

(74) *Attorney, Agent, or Firm* — Wood Herron & Evans LLP

(57) ABSTRACT

A subassembly for a bottom hole assembly of a drill string, the subassembly comprising: a tubular portion having a wall for supporting one or more sensors and an inner surface defining a longitudinal bore; a probe assembly comprising a main body, the probe assembly being removably located in the bore and positioned such that a flow channel for drilling fluid is defined between the inner surface of the tubular portion and the probe assembly. A communications link for data transfer between the probe assembly and a sensor supported by the tubular portion.

23 Claims, 9 Drawing Sheets

(51) Int. Cl.
*E21B 47/06* (2012.01)
*E21B 49/00* (2006.01)

(56) References Cited

U.S. PATENT DOCUMENTS

| | | | | |
|---|---|---|---|---|
| 7,336,199 | B2 * | 2/2008 | Lasater | E21B 47/12 340/853.1 |
| 8,810,428 | B2 * | 8/2014 | Madhavan | E21B 4/02 175/40 |
| 9,217,299 | B2 * | 12/2015 | Moriarty | E21B 47/122 |
| 9,245,683 | B2 * | 1/2016 | Zhao | E21B 17/028 |
| 9,347,277 | B2 * | 5/2016 | Taherian | E21B 17/028 |
| 9,464,489 | B2 * | 10/2016 | MacDougall | E21B 23/08 |
| 10,301,931 | B2 * | 5/2019 | Derkacz | E21B 47/122 |
| 10,358,909 | B2 * | 7/2019 | Bittar | E21B 47/01 |
| 2009/0085701 | A1 | 4/2009 | Veneruso et al. | |
| 2013/0181799 | A1 | 7/2013 | Deville et al. | |
| 2015/0167466 | A1 * | 6/2015 | Teodorescu | E21B 47/01 175/40 |
| 2019/0024462 | A1 * | 1/2019 | Sugiura | E21B 47/12 |

OTHER PUBLICATIONS

Intellectual Property Office, Search and Examination Report in GB1703393.7, dated Jun. 15, 2017.
Intellectual Property Office, Search and Examination Report in GB1802416.6, dated Jun. 28, 2018.

* cited by examiner

SUBASSEMBLY FOR A BOTTOM HOLE ASSEMBLY OF A DRILL STRING WITH COMMUNICATIONS LINK

TECHNICAL FIELD

The present invention relates to a subassembly for a bottom hole assembly of a drill string. In particular, the present invention relates to a subassembly for a bottom hole assembly of a drill string, the subassembly having a tubular portion, an electronic probe assembly separated from the tubular portion by a flow channel, and a communication link for transferring data between the probe assembly and sensors supported by the tubular portion. The present invention also relates to a method of transferring data in a bottom hole assembly of a drill string.

BACKGROUND

Wellbores are generally drilled using a drilling string formed of a number of drill pipes connected end to end which extends from the surface to a bottom hole assembly (BHA) at its terminal end. The bottom hole assembly (BHA) in an oil well drilling string typically consists of a drill bit at the bottom, and above that a motor and power section. The power section is essentially a turbine that extracts power from the flow of drilling mud pumped from the surface and rotates the drill bit. Above the power section there are typically a number of heavy drill collars that add mass to the bottom hole assembly. These contain a central bore to allow the flow of drilling mud through to the power section. The wellbore is drilled by the BHA in order to reach a subterranean formation of interest which may then be assessed, for example to determine whether hydrocarbons may be present in the formation.

Initially, wellbores were drilled without any form of directional monitoring while drilling. Instead, sections of wells were surveyed after they had been drilled, by which time they could easily have deviated significantly from their intended path. To address this problem, Measurement While Drilling (MWD) equipment was introduced using accelerometers and magnetometers to determine the orientation of the drill string during drilling. This information could be conveyed to the surface in real time, usually in the form of pressure pulses in the drilling mud column pumped from the surface.

MWD equipment is typically contained in a small diameter probe assembly that sits within a drill collar such that an annular space exists between the probe assembly and the drill collar to allow the passage of drilling mud around the probe assembly and down to the power section. In some examples, the probe assembly is supported within the drill collar with centralisers at the base of the probe assembly and higher up. The centralisers usually consist of rubber fins or metal bow springs and support the probe assembly such that an annular space exists between the probe assembly and the drill collar. In other examples, the probe assembly is removably seated within a sleeve which is fixed inside the drill collar. For example, the probe assembly may be supported within the sleeve of a mule shoe held inside the collar. Typically, the probe assembly is seated in its support such that it is held to a specific rotation but is not otherwise fixed relative to the drill collar. This allows the probe assembly to be removed from the BHA by lowering a cable assembly down the inside of the drill pipe and collars, attaching it to the top of the probe and hoisting it back to the surface. This operation may be performed, for example to replace batteries or faulty equipment in the probe, without the need to remove the BHA, collars and all the drill pipe from the well, which is a very time-consuming process. Once the batteries or faulty equipment have been replaced, the probe assembly may be lowered back into the BHA and drilling may recommence. This retrievability and reseatability is viewed in the industry as very desirable.

In addition to the presence of MWD equipment in the probe assembly to determine the orientation of the drill string, additional sensors, such as natural gamma ray sensors and shock and vibration monitors, may also be included in the probe assembly and their data included in the data stream sent to the surface. These sensors may allow measurements relating to the properties of a formation to be transmitted to the surface while drilling is taking place, or in "real-time". Such Logging While Drilling (LWD) equipment allows measurement results to be obtained before drilling fluids invade the formation deeply and may allow measurements to be obtained from the formation in the event that subsequent wireline operations are not possible.

However, the probe assembly is not the ideal location for all sensors. Some sensors, such as bore pressure sensors and formation resistivity sensors, need access to the borehole surrounding the drill collar and, therefore, must be mounted on an outer surface of a drill collar. Communicating with such tools has presented the industry with something of a challenge. Some attempts at solving this problem have involved securely bolting the probe assembly to the inside surface of the collar to allow physical and pressure sealed connection between the collar-mounted sensor and the probe assembly through an aperture in the collar. However, this results in the loss of retrievability and reseatiblity of the probe assembly independent of the drill collar.

Accordingly, it would be desirable to provide a subassembly for the bottom hole assembly of a drill string having a probe assembly and with which data can be easily transferred between a sensor and the probe assembly without compromising the retrievability of the probe assembly.

SUMMARY

According to a first aspect of the present invention there is provided a subassembly for a bottom hole assembly of drill string, the subassembly comprising: a tubular portion having a wall for supporting one or more sensors and an inner surface defining a longitudinal bore; a probe assembly removably located in the bore and positioned such that a flow channel for drilling fluid is defined between the inner surface of the tubular portion and the probe assembly; and a wireless communications link for data transfer between the probe assembly and a supported by the tubular portion. The wireless communications link includes a probe coil forming part of the probe assembly and connectable to a probe data line, and a tubular portion coil forming part of the tubular portion and connectable to a sensor data line. The probe coil and the tubular portion coil are positioned such that an inductive coupling is achieved across the flow channel between the probe coil and tubular portion coil to allow data transfer between the probe data line and the sensor data line using the inductive coupling.

With this arrangement, there is no requirement for any electrical connectors to be used between the probe assembly and the tubular portion. Instead, the tubular portion and the probe assembly are able to communicate wirelessly. This allows the probe assembly to be retrieved from and reseated in the bore even when used with a sensor located outside of the tubular portion. It may also be of particular benefit when the probe collar is used with a water-based drilling mud, which is highly conductive, since the mud could short-circuit any electrical connectors provided between the probe assembly and the tubular portion.

The probe assembly is removably located in the bore. This means that the probe assembly is not secured to the tubular portion, but rests within the tubular portion such that it can be retrieved from above and independently of the tubular portion. For example, the probe assembly may rest against one or more stops in the tubular portion such that the probe assembly is located in the bore only under the action of its own weight.

As used herein, the term "tubular portion" refers to an open-ended and hollow structure which is intended to form part of the flow path for drilling mud through the bottom hole assembly. For example, the tubular portion may be a collar or a sub which is intended to define an outer surface of the bottom hole assembly such that it forms part of the length of the bottom hole assembly. In such examples, the term "subassembly" refers to a combination of the collar or sub and the probe assembly. Alternatively, the tubular portion may be a sleeve or insert which is intended for insertion into a collar or sub of the bottom hole assembly. In such examples, the term "subassembly" refers to a combination of the sleeve and the probe assembly.

The tubular portion coil is preferably connected to transmitter electric circuitry configured to operate the tubular portion coil as a transmitter coil, and the probe coil connected to receiver electric circuitry configured to operate the probe coil as a transmitter coil. In this manner, data may be transferred from a sensor connected to the tubular portion coil to the probe assembly, via a sensor data line and the inductive coupling. The data may then be transferred to the surface via the probe assembly and a surface telemetry system. The receiver electric circuitry and the transmitter electric circuitry may include one or more electric components selected from a list including analogue to digital converters, power control, amplifiers, comparators, timing, data clock and flow detection devices along with data management logic devices.

The probe coil is connectable to a probe data line and the tubular portion coil is connectable to a sensor data line. In each case, the coil may be connected via a standard electrical interface or data transfer mechanism, forming part of the subassembly. For example, suitable standard interfaces include, but are not limited to, RS-232, RS-422 and RS-485.

The probe coil may be connected to transmitter electric circuitry configured to operate the probe coil as a transmitter coil, and the tubular portion coil connected to receiver electric circuitry configured to operate the tubular portion coil as a receiver coil. In this manner, data may be transferred from the probe assembly to a sensor connected to the tubular portion coil, via the inductive coupling and a sensor data line. The data may, for example contain instructions to the sensor from the surface, which are provided to the probe assembly via a communications bus.

In preferred embodiments, the probe coil and the tubular portion coil are both connected to transmitter electric circuitry and to receiver electric circuitry so that both the probe coil and the tubular portion coil are operable as a transmitter coil or a receiver coil. In this manner, data may be transferred in both directions between the probe assembly and a sensor, via the inductive coupling and a sensor data line. In such embodiments, the probe data line and the sensor data line are preferably each a single bi-directional data line. Otherwise, the probe data line and the sensor data line may each be formed from two data lines, each configured to carry data in a single direction.

In preferred embodiments, the receiver electric circuitry is configured to amplify and filter a remote transmission signal inductively received by the receiver coil to generate an amplified and filtered signal, generate a voltage signal proportional to a recent amplitude of the amplified and filtered signal, and compare the amplified and filtered signal to the voltage signal to determine if the remote transmission signal has recently ended.

As used herein, the term "recent amplitude" refers to the amplitude of the amplified and filtered signal within a previous predetermined time period, or number of cycles of the carrier frequency of the signal. For example, the recent amplitude may refer to the amplitude of the amplified signal within the previous 6 or 7 cycles of the carrier frequency. In such a case, where an 850 kHz carrier frequency is used, the "recent amplitude" equates to the amplitude of the amplified signal within the previous 7 to 8 microseconds. The recent amplitude may refer to the amplitude of the amplified signal at a specific point in time. In other examples, the recent amplitude may be a moving average of the amplitude of the amplified signal for the predetermined time, or number of cycles of the carrier signal, immediately prior to the generation of the output voltage signal. In certain examples, the "recent amplitude" refers to the moving average of the amplitude of the amplified signal for the previous 6 cycles of the carrier frequency.

Preferably, the receiver electric circuitry is further configured to generate an output pulse train having an output pulse for each peak of the amplified and filtered signal that exceeds the voltage signal and to drive an output data line to which it is connected according to the output pulse train.

Preferably, the receiver electric circuitry further comprises a missing pulse detector configured to compare the output pulse train to an expected output pulse train and to indicate that the remote transmission signal has recently ended if one or more expected output pulses are missing from the output pulse train.

In such embodiments, the receiver electric circuitry is preferably configured to drive the output data line high when the output pulse train substantially corresponds to the expected output pulse train and to drive the output data line low when the missing pulse detector indicates that the remote transmission signal has recently ended.

Advantageously, the wireless communications link as described above does not require any knowledge of the protocol in use, nor the Baud rate currently in use by the communications bus in the drilling string. Furthermore, it isn't required to have any understanding of the data that it is relaying between probe assembly and collar. This removes many layers of complexity and provides a system that is to a very large extent protocol and modulation scheme independent.

Preferably, the transmitter electric circuitry and the receiver electric circuitry of the wireless communications link are configured to transfer data in real time. This means that the wireless communications link can relay data without substantially delay and without the need for modifications to the communications protocol or to the firmware of equipment on either side of the wireless communications link. This results in a subassembly which can be easily combined with other downhole equipment without the need for modifications to that equipment or its firmware in order to function correctly.

In any of the above embodiments, the probe coil may be wound around the outer surface of the probe assembly and the tubular portion coil may be wound around the inner surface of the tubular portion.

In any of the above embodiments, the tubular portion coil and the probe coil may be wound such that they protrude into the flow channel. In other examples, one or both of the tubular portion and the probe assembly comprises a recess in which its respective coil is located. Preferably, the tubular portion comprises a recess on its inner surface in which the tubular portion coil is located, and the probe assembly comprises a recess on its outer surface in which the probe coil is located.

With this arrangement, the coils are recessed into the probe assembly and the tubular portion to provide protection from damage or dislodgement due to the flow of drilling mud.

The recesses may be exposed at their openings. Alternatively, one or both of the recesses may be provided with a non-magnetic and non-metallic cover extending over its opening to seal the radial groove from drilling fluid. Preferably, each of the recesses is provided with a cover extending over its opening to seal the radial groove from drilling fluid.

With this arrangement, the coils are isolated from the drilling fluid by the covers. This means that the coils are protected from physical damage during drilling. It also means that the coils can be used with conductive drilling fluid, such as water-based drilling fluid without the risk of shorting of the coils by the drilling fluid. This, coupled with the fact that there is no direct electrical or physical connection between the probe assembly and the tubular portion equipment, also means that the probe assembly can be removed from the tubular portion without exposing any electrical wiring. This differs from some known systems in which releasable electrical connectors are used to form an electrical connection between the probe assembly and a collar-mounted sensor. Such connectors may be short circuited by water-based drilling fluid unless additional seals, such as O-rings, are provided. Where additional seals are provided, these may increase the difficulty with which the electrical connection is re-established and may not perform well in the presence of particulates, such as sand, in the drilling fluid which can prevent an adequate seal from being formed.

The covers are preferably non-magnetic.

Where the recesses are sealed using covers, the radial grooves may contain a non-conductive fluid to assist with the sealing of the grooves from the drilling fluid.

The covers may be configured to seal the recesses against pressures experienced during operation. For example, the covers may be configured to seal the recesses against a pressure of 1,400 atmospheres.

One or both of the tubular portion coil and the probe coil may be in direct contact with one or more of the edges of the recess in which it is located. Preferably, one or both of the probe coil and the tubular portion coil is spaced from the edges of its respective recess by a clearance. With this arrangement, eddy current losses from the coils to the surrounding material in which the recess is formed may be reduced. This may improve coupling between the coils across the flow channel, as well as coil efficiency. The necessary clearance depends on the arrangement of a particular coil. However, it has been found that a clearance of greater than 0.05 inches (1.25 mm), preferably greater than 0.1 inches (2.5 mm) is particularly effective. For example, the clearance may be from about 0.05 inches (1.25 mm) to about 0.6 inches (15 mm), preferably from about 0.1 inches (2.5 mm) to about 0.5 inches (12.5 mm). The clearance may be provided between the coil and any one of the three edges of its respective recess.

Where one or both of the tubular portion coil and the probe coil are located in a recess, the recess may be formed such that it is open on only one side of the tubular portion or probe assembly. In such embodiments, the tubular portion coil and probe coil may be located on only one side of the tubular portion and probe assembly, respectively, and the magnetic axes of the coils are offset from each other. This may result in a recess which is easier to seal from drilling fluid than a recess extending around the probe assembly or around the inner surface of the tubular portion. In such embodiments, the coils may each be wound around a core located in the recess.

In other examples, the recess of the tubular portion may comprise a radial groove on its inner surface in which the tubular portion coil is wound and wherein the recess of the probe assembly comprises a radial groove on the outer surface of the probe assembly in which the probe coil is wound. In such embodiments, the magnetic axes of the coils may be substantially aligned. This reduces the need for the coils to be rotationally aligned, as may be the case for coils which are located on only one side of the subassembly.

The probe coil may be powered by a battery or a downhole power generator. The tubular portion coil may be powered by a battery or a downhole power generator. The probe coil and the tubular portion coil may each be independently powered by a battery or a downhole power generator.

Preferably, the tubular portion coil and the probe coil are both tuned to a frequency of from about 500 kHz to about 2 MHz, preferably from about 700 kHz to about 1.2 MHz, more preferably of about 850 kHz. The choice of frequency depends on the diameters of the probe assembly and the tubular portion and on the frequencies used by surrounding equipment.

These frequencies have been found to result in a reduced risk of interference between the wireless communications link and electromagnetic signals generated by other electrical equipment, such as resistivity sensors, in the vicinity of the wireless communications link. Further, these frequencies result in a very low operating power requirement for the coils. For example, at a frequency of around 1 MHz, each side of the wireless communications link consumes power in the order of only 100 mW.

Additionally, it has been found that conductivity in water based drilling mud is mostly ionic conduction caused by dissolved salts, that ionic conduction decreases very rapidly as frequency is increased, and that at frequencies approaching 1 MHz, these ions are in fact not very mobile. Consequently, when operated at frequencies approaching 1 MHz, even a hot water based mud will not have a significant detrimental effect on the performance of the wireless communications link.

The inductive coupling formed by the tubular portion coil and the probe coil may have a quality factor (Q) of above 10. Preferably, the inductive coupling between the tubular portion coil and the probe coil has a quality factor (Q) of from about 6 to about 10.

By having an inductive circuit with a lower Q value, the starting and stopping of a transmission can both be detected within a very short time. This results in a very low latency between data arriving at the transmitter coil and that same data being driven on the receiver data line. For example, with a frequency of about 850 kHz and a Q of about 10, latency is typically less than 2.5 μs and furthermore, the matching between start and stop latencies is typically of the order of 0.5 μs. Another advantage of using a relatively low Q is that the receiver and transmitter resonant circuits do not need to be highly tuned and are not highly frequency selective. This, together with the abundance of signal amplitude, makes this system highly tolerant of frequency drift, a great comfort in any system that is required to operate at temperatures as high as 175° C. and as low as −40° C.

The subassembly may comprise one or more sensors mounted on or in the wall of the tubular portion and a sensor data line connected to the one or more sensors. Data may then be transferred between the probe assembly and the sensor using the wireless communications link. The subassembly may comprise a plurality of sensors mounted on or in the wall of the tubular portion. The sensors may each be connected to the wireless communications link by the sensor data line. The collar-mounted sensors may each be connected to the wireless communications link by two or more sensor data lines connected to the collar coil. Data may then be transferred between the probe assembly and each of the plurality of collar-mounted sensors using the single wireless communications link. Alternatively, the collar may comprise a plurality of collar coils and probe coils forming a plurality of wireless communications links to which the plurality of collar-mounted sensors are connected.

The one or more sensors may be selected from a list including inclinometers, array sensors, accelerometers, internal pressure transducer, annulus pressure transducer, gamma, azimuthal gamma, micro hop Tx, power hop Tx short hop receiver, torque, stretch and other drilling dynamics sensors.

According to a second aspect of the present invention, there is provided a method of transferring data in a bottom hole assembly of a drill string, the method comprising the steps of: providing a subassembly comprising: a tubular portion having a wall for supporting one or more sensors and an inner surface defining a longitudinal bore; a probe assembly removably located in the bore and positioned such that a flow channel for drilling fluid is defined between the inner surface of the tubular portion and the probe assembly; and a wireless communications link including a probe coil forming part of the probe assembly and connected to a probe data line and a tubular portion coil forming part of the tubular portion and connected to a sensor data line; forming an inductive coupling between the probe coil and the tubular portion coil; transmitting a data signal across the flow channel by driving one of the probe coil and the tubular portion coil as a transmitter coil; and inductively receiving the data signal by operating the other one of the probe coil and the tubular portion coil as a receiver coil.

The advantages of the method according to the second aspect of the invention are substantially the same as described above for the collar of the first aspect.

In preferred embodiments, the step of inductively receiving the data signal is carried out by: detecting an inductively received remote transmission signal using the receiver coil; amplifying and filtering the remote transmission signal to generate an amplified and filtered signal; generating a voltage signal proportional to a recent amplitude of the amplified and filtered signal; and determining if the remote transmission signal has recently ended by comparing the amplified and filtered signal to the voltage signal.

Preferably, the method further comprises the steps of: generating an output pulse train having an output pulse for each peak of the amplified and filtered signal that exceeds the voltage signal; and driving an output data line, to which the receiver coil is connected, according to the output pulse train.

Preferably, the step of determining if the remote transmission signal has recently ended is carried out by comparing the output pulse train to an expected output pulse train; and indicating that the remote transmission signal has recently ended if one or more expected output pulses are missing from the output pulse train. The method may further comprise the steps of driving the data line high when the output pulse train substantially corresponds to the expected output pulse train; and driving the output data line low when one of more expected output pulses are missing from the output pulse train.

Advantageously, the wireless communications link as described above does not require any knowledge of the protocol in use, nor the Baud rate currently in use by the communications bus in the drilling string. Furthermore, it isn't required to have any understanding of the data that it's relaying between probe assembly and the tubular portion. This removes many layers of complexity and provides a system that is to a very large extent protocol and modulation scheme independent.

According to a third aspect of the present invention, there is provided a subassembly for a bottom hole assembly of a drill string, the subassembly comprising: a tubular portion having a wall for supporting one or more sensors and an inner surface defining a longitudinal bore; and a probe assembly removably located in the bore and positioned such that a flow channel for drilling fluid is defined between the inner surface of the tubular portion and the probe assembly; wherein: the probe assembly comprises a probe coil, and the tubular portion comprises a tubular portion coil arranged to form an inductive coupling with the probe coil across the flow channel; and wherein: the probe assembly further comprises probe transmitter electric circuitry connected to the probe coil and configured to send a drive signal to the probe coil; and the tubular portion further comprises tubular portion receiver electric circuitry connected to the tubular portion coil and configured to process a signal inductively received by the tubular portion coil from the probe coil, and generate an output data signal corresponding to the drive signal generated by the probe transmitter electric circuitry, such that a wireless communication link can be formed between the probe assembly and the tubular portion.

Preferably, the tubular portion receiver electric circuitry is connectable to a sensor data line and configured to check the status of the sensor data line in response to receiving a signal from the tubular portion coil.

Preferably, the receiver electric circuitry does not identify a signal on the sensor data line, the receiver electric circuitry is configured to drive the sensor data line based on the signal received from the tubular portion coil.

According to a fourth aspect of the present invention, there is provided a subassembly for a bottom hole assembly of a drill string, the subassembly comprising: a tubular portion having a wall for supporting one or more sensors and an inner surface defining a longitudinal bore; and a probe assembly removably located in the bore and positioned such that a flow channel for drilling fluid is defined between the inner surface of the tubular portion and the probe assembly; wherein: the probe assembly comprises a probe coil, and the tubular portion comprises a tubular portion coil arranged to form an inductive coupling with the probe coil across the flow channel; and wherein: the tubular portion further comprises tubular portion transmitter electric circuitry connected to the tubular portion coil and configured to send a drive signal to the tubular portion coil; and the probe assembly further comprises probe receiver electric circuitry connected to the probe coil and configured to process a signal inductively received by the probe coil from the tubular portion coil, and generate an output data signal corresponding to the drive signal generated by the tubular portion transmitter electric circuitry, such that a wireless communication link can be formed between the probe assembly and the tubular portion.

Preferably, the probe receiver electric circuitry is connectable to a probe data line and configured to check the status of the probe data line in response to detecting a transmission on the probe coil.

Preferably, the receiver electric circuitry does not identify a signal on the sensor data line, the receiver electric circuitry is configured to drive the probe data line based on the signal received from the probe coil.

Preferably, the output data signal is a replication of the drive signal with a delay of less than about 5 microseconds.

Preferably, the output data signal and the drive signal are square wave signals.

Preferably, the output data signal can be produced without reference to a communications Baud rate and/or protocol.

Features described in relation to one or more aspects may equally be applied to other aspects of the invention. In particular, features described in relation to the apparatus of the first aspect may be equally applied to the method of the second aspect, and vice versa. Furthermore, features described in relation to the apparatus of the first aspect may be equally applied to the apparatus of the third or fourth aspects, and vice versa.

BRIEF DESCRIPTION OF THE DRAWINGS

The invention is further described, by way of example only, with reference to the accompanying drawings in which.

DETAILED DESCRIPTION

Figure 1:
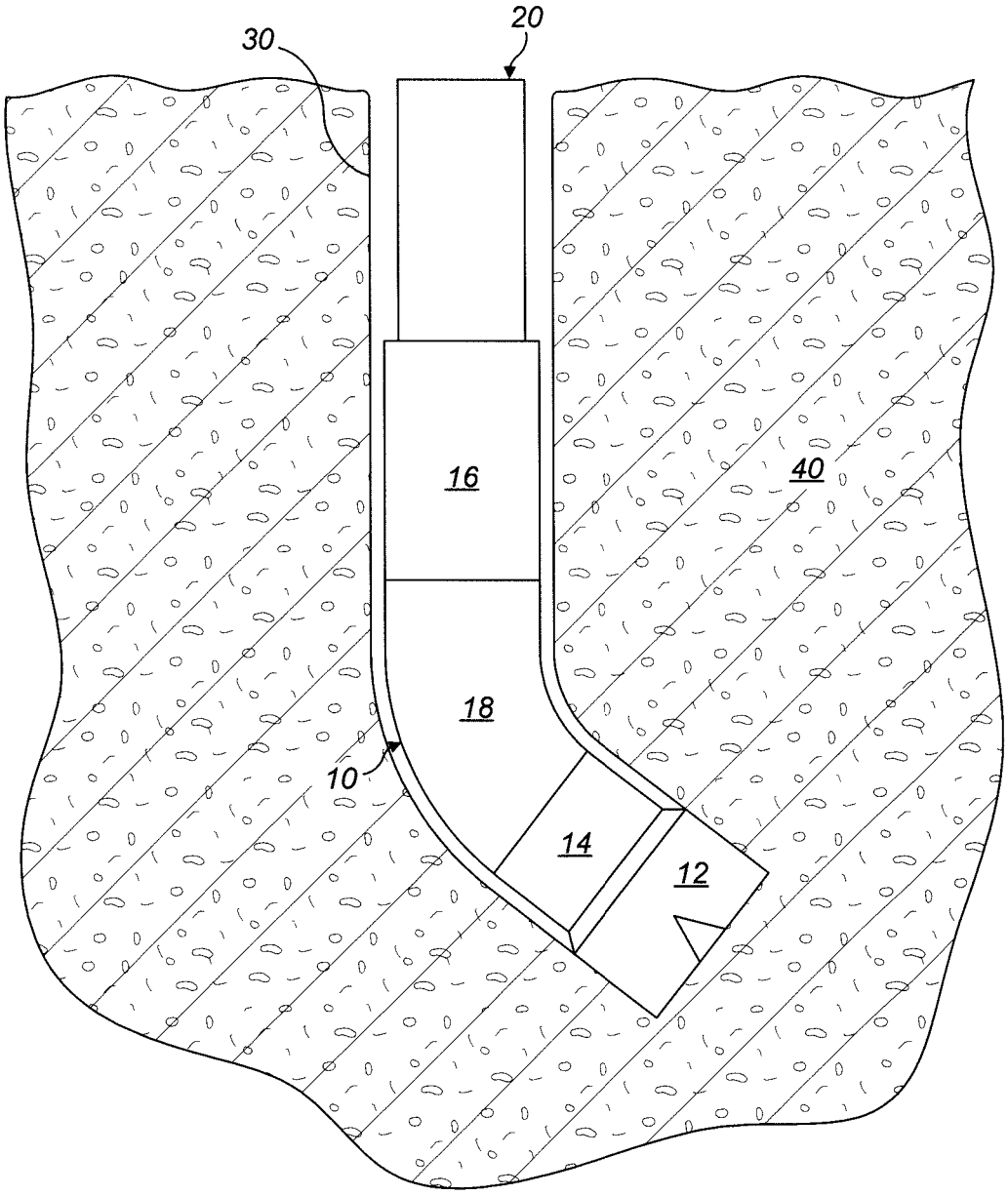
FIG. 1 shows a schematic view, partly in cross-section, of a drilling apparatus including a bottom hole assembly disposed in a subterranean well.

Referring to FIG. 1, a drilling apparatus including a probe within a collar according to the present invention is shown. The drilling apparatus includes a bottom hole assembly 10 located at the lower end of a drill string 20 which extends from a drilling platform (not shown) at the surface to the bottom hole assembly 10. The bottom hole assembly 10 includes a drill bit 12 at is lower end and a power section and drill motor 14 above the drill bit 12. In use, drilling fluid, or "drilling mud", is pumped from the surface to the bottom hole assembly through the drill string 20. The power section 14 acts as a turbine to extract power from the flow of drilling mud to rotate the drill bit 12. In this manner, the drill bit 12 forms a wellbore 30 through the formation material 40 in which the drill string 20 is located. The bottom hole assembly 10 also includes a number of drill collars 16, which add mass to the bottom hole assembly 10 and which define a central bore through which the drilling mud may be pumped to the power section 14. The bottom hole assembly 10 also includes a tool string 18 comprising a number of individual collars or subs connected together. The tool string may include one or more measurement while drilling (MWD) and logging while drilling (LWD) tools. A communications bus (not shown) runs the entire length of the tool string 18 to allow communications with the various tools along the tool string and to allow data to be transmitted from the tools towards the surface.

Figure 2:
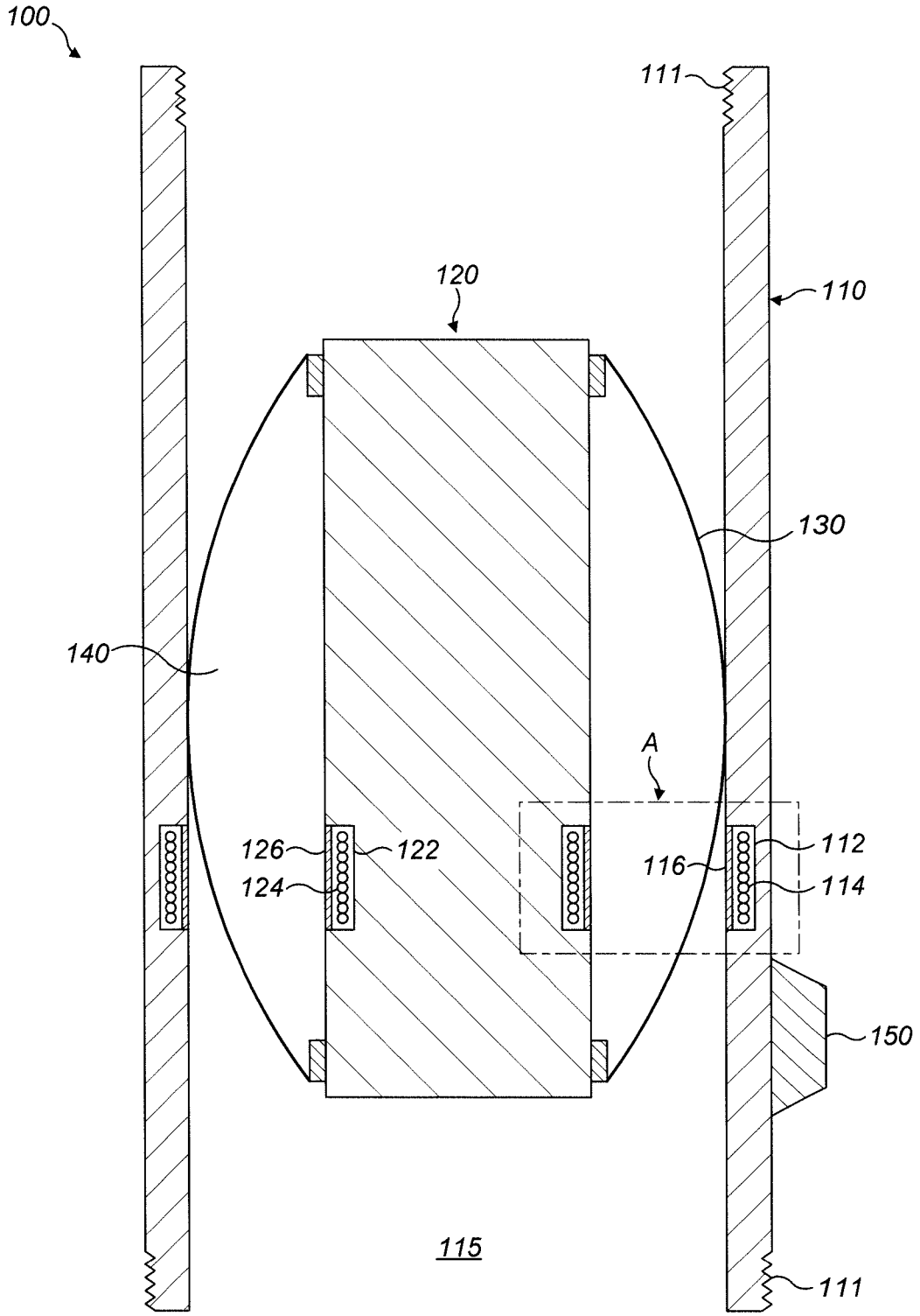
FIG. 2 shows a schematic cross-section of a first embodiment of subassembly for the bottom hole assembly in FIG. 1.

Referring to FIG. 2, a first embodiment of subassembly 100 for the bottom hole assembly of FIG. 1 is shown. The subassembly 100 includes a tubular portion in the form of a collar 110 having a longitudinal bore 115, and a probe assembly 120 removably located in the longitudinal bore 115. The probe assembly 120 may include, for example, a range of equipment such as pressure pulsers for communication to the surface, directional sensors, gamma sensors, vibration sensors, control electronics, centralizers, batteries, control electronics and retrieval assemblies. The tubular collar 110 includes threaded connections 111 at its upper and lower ends by which the collar 100 may be connected to other components in the drill string. In this example, the probe assembly 120 is suspended within the tubular collar 110 by centralisers 130 in the form of metal bow springs, rubber standoffs or other means. The centralisers 130 are fixed to the probe assembly 120 and press against the inner surface of the collar 110 to temporarily seat and stabilize the probe assembly 120 within the bore 115. This arrangement allows the probe assembly to be removed from above while preventing downward movement or rotation of the probe assembly 120 about the central axis of the probe collar 100. When the probe assembly 120 is located within the bore 115, an annular flow channel 140 is defined in the section of the bore 115 between the inner surface of the tubular collar 110 and the probe assembly 120 to allow the flow of drilling mud through the probe collar 100 around the probe assembly 120. One or more collar-based sensors 150 are supported by the collar 110 to obtain measurements directly from the wellbore or relating to their position in the wellbore or drill string. In this example, the sensor 150 is mounted on the outer surface of the collar 110. In other examples, the sensor 150 or sensors may be mounted on the inner surface of the collar, or in the wall of the collar. The measurements obtained from the sensor 150 are communicated to the probe assembly 120 using a wireless communications link. The wireless communications link may also allow two-way data transfer so that the probe assembly may communicate with the sensor, for example to provide data pertaining to; start-stop signals, configuration changes, pressure data, gamma, inclination, acceration, torque, stretch and others The wireless communications link is formed from the inductive coupling of a first induction coil 112, or "tubular portion coil", provided on the collar 110 and a second induction coil 122, or "probe coil", provided around the probe assembly 120. The tubular portion coil 112 is wound in a radial groove 114 formed in and circumscribing the inner surface of the tubular collar 110. Similarly, the probe coil 122 is wound in a radial groove 124 formed in and extending around the outer surface of the probe assembly 120. To allow the grooves 114, 124 to be sealed against drilling mud, a non-magnetic and non-metallic cover 116, 126 is provided over the opening of each of the grooves 114, 124. The coils would be typically moulded or encapsulated into the protective cover seal or covered by a sleeve with pressure seals. To assist the covers 116, 126 with sealing against drilling mud, the grooves 114, 124 may also contain oil, although this is not considered to be essential.

For arrangements in which the subassembly 100 has more than one collar-based sensor 150, these sensors may be connected to the first induction coil 112 by a communications bus (not shown) running along the tubular portion, and data from each sensor transmitted between the sensors 150 via a single wireless communications link. Alternatively, the tubular collar 110 and probe assembly 120 may include a plurality of similar wireless communication links by which data may be transferred between the probe assembly 120 and the plurality of collar-based sensors 150.

Figure 3:
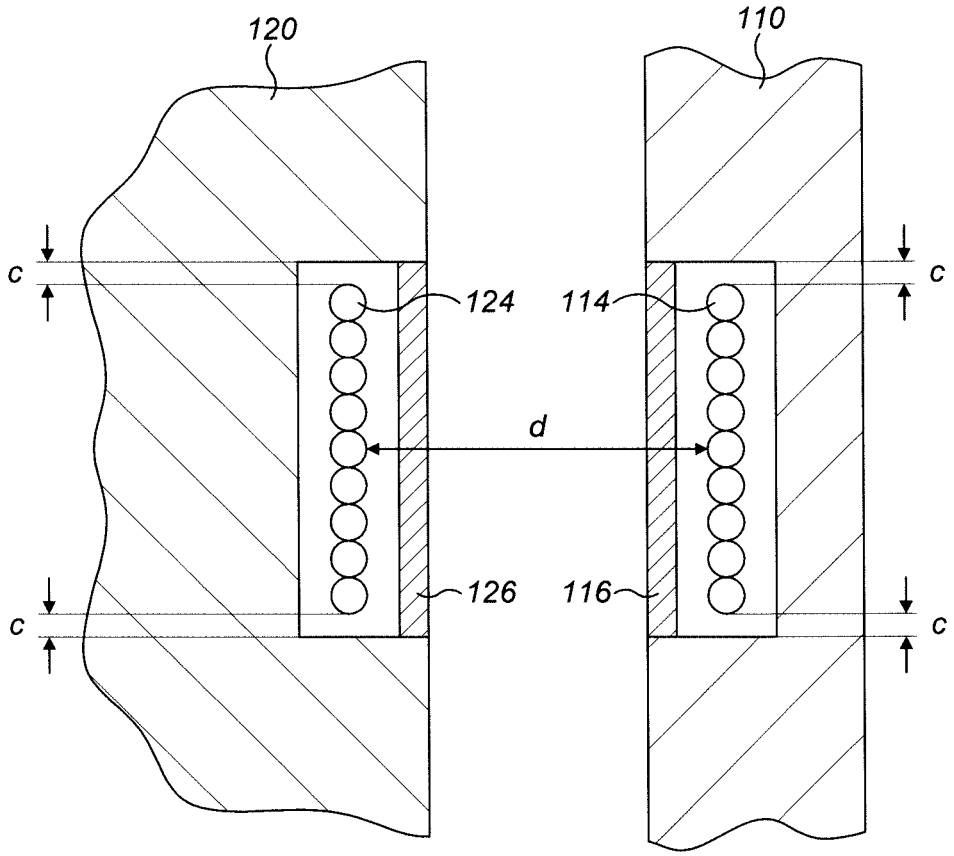
FIG. 3 shows an enlarged cross-section of detail A in FIG. 2.

Referring to FIG. 3, an enlarged cross-section of detail A in FIG. 2 is shown. This is an enlarged view of part of the tubular portion coil 114, or "collar coil", and part of the probe coil 124. As can be seen, the coils 114, 124 are wound in their respective radial grooves 112, 122 such that there is a clearance c between the wires of the coil 114, 124 and the edges of the radial groove 112, 122. Thus, the coils 114, 124 are separated from the surrounding metalwork of the collar 110 and of the probe assembly 120, respectively. The clearance may be modest and it has been found that a clearance of around 0.1 inches (2.5 mm) is generally sufficient. As also shown in FIG. 3, the first and second induction coils 114, 124 are separated by a distance d extending across the annular flow space 150 and over which the first and second induction coils 114, 124 are inductively coupled. The magnitude of the distance d will depend on the inner diameter of the collar 110 and the outer diameter of the probe assembly 120. For example, where the collar has an inner diameter of 3.75 inch (about 9.5 cm), the distance d is generally in the region of up to 1 inch (about 2.5 cm). The first and second induction coils may have any suitable number of turns. The optimal number of turns depends on the gauge of the wire, the current available to drive the signal, magnetic interference, wellbore fluid and other factors which vary with the desired application.

Figure 4:
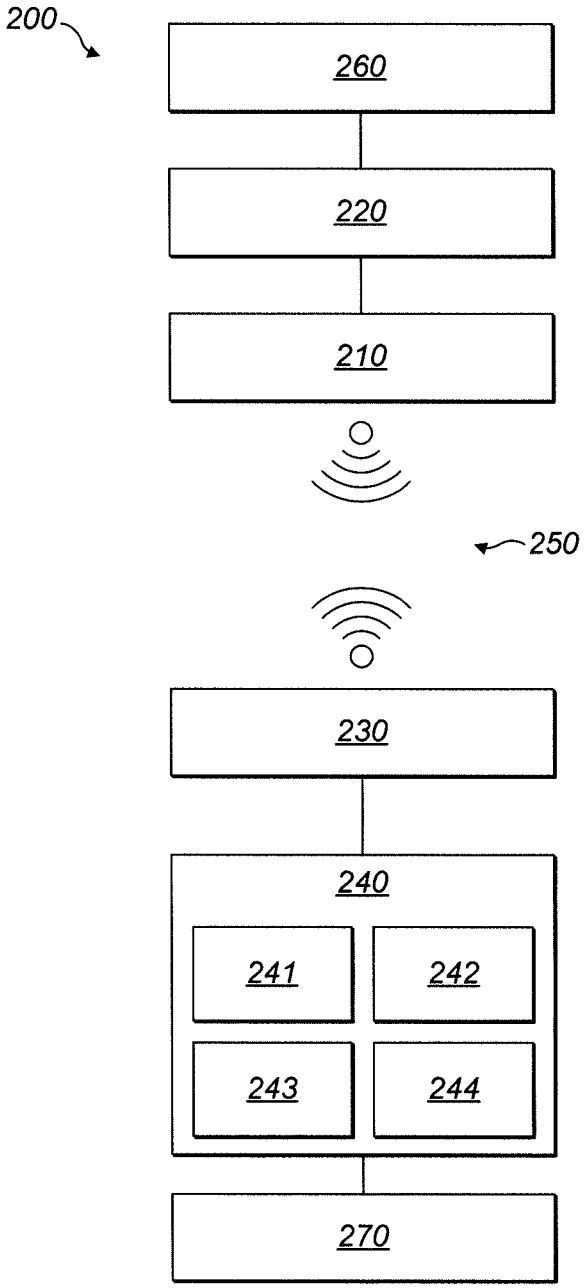
FIG. 4 shows a schematic illustration of the wireless communications link in the subassembly of FIG. 2.

Referring to FIG. 4, the wireless communications link 200 of the subassembly 100 is shown. The wireless communications link 200 includes a transmitter coil 210 connected to transmitter electric circuitry 220 and a receiver coil 230 connected to receiver electric circuitry 240. The transmitter coil 210 and the receiver coil 230 are inductively coupleable to form an inductive circuit 250. The transmitter electric circuitry 220 is connected to a data line 260 for providing data to the transmitter coil 210, and the receiver electric circuitry 240 is connected to a data line 270 for onward transfer of data from the receiver coil 230.

In this embodiment, both the collar coil and the probe coil are operable as the transmitter coil and as the receiver coil. In other words, two sets of transmitter electric circuitry 220 and receiver electric circuitry 240 are provided, with the collar coil and the probe coil each connected to one transmitter electric circuitry 220 and one receiver electric circuitry 240. In this manner, there may be a two-way transfer of data between the probe assembly and the collar equipment. However, for the purpose of clarity, FIG. 4 shows only one set of transmitter electric circuitry 220 and receiver electric circuitry 240. In other examples, where only one-way data transfer is required, the wireless communications link may include only one set of transmitter electric circuitry 220 and one set of receiver electric circuitry 240. For example, where data transfer from the sensor to the probe assembly is required, the collar coil is connected to the transmitter electric circuitry and forms the transmitter coil, while the probe coil is connected to the receiver electric circuitry and forms the receiver coil. In this example, the data lines 260, 270 are single bi-directional data lines. However, one or both of the data lines 260, 270 could be formed from a plurality of data lines.

The transmitter electric circuitry 220 includes a driver for powering the transmitter coil 210 according to data received from the transmitter data line 260, while the receiver electric circuitry 240 includes an amplifier 241, a fast-acting level detector 242, a comparator 243 and a pulse detector 244 connected to the receiver data line 270. Both the probe assembly with transmitter coil and the collar assembly with transmitter coil are powered by separate and independent batteries or power generators within the probe and collar assemblies.

In use, the bi-directional data lines 260, 270 idle low (0V), which also signals a digital "0", and a digital "1" is signalled by an excursion to 5V or other appropriate voltage depending on the application. The modulation is NRZ (non-return to zero) meaning that if two consecutive "1"s are transmitted the result on the bus appears as a double width pulse to 5V.

With reference to FIGS. 4 and 5A to 5D, the operation of the wireless communications system will now be described.

Figures 5A, 5B, 5C, 5D:
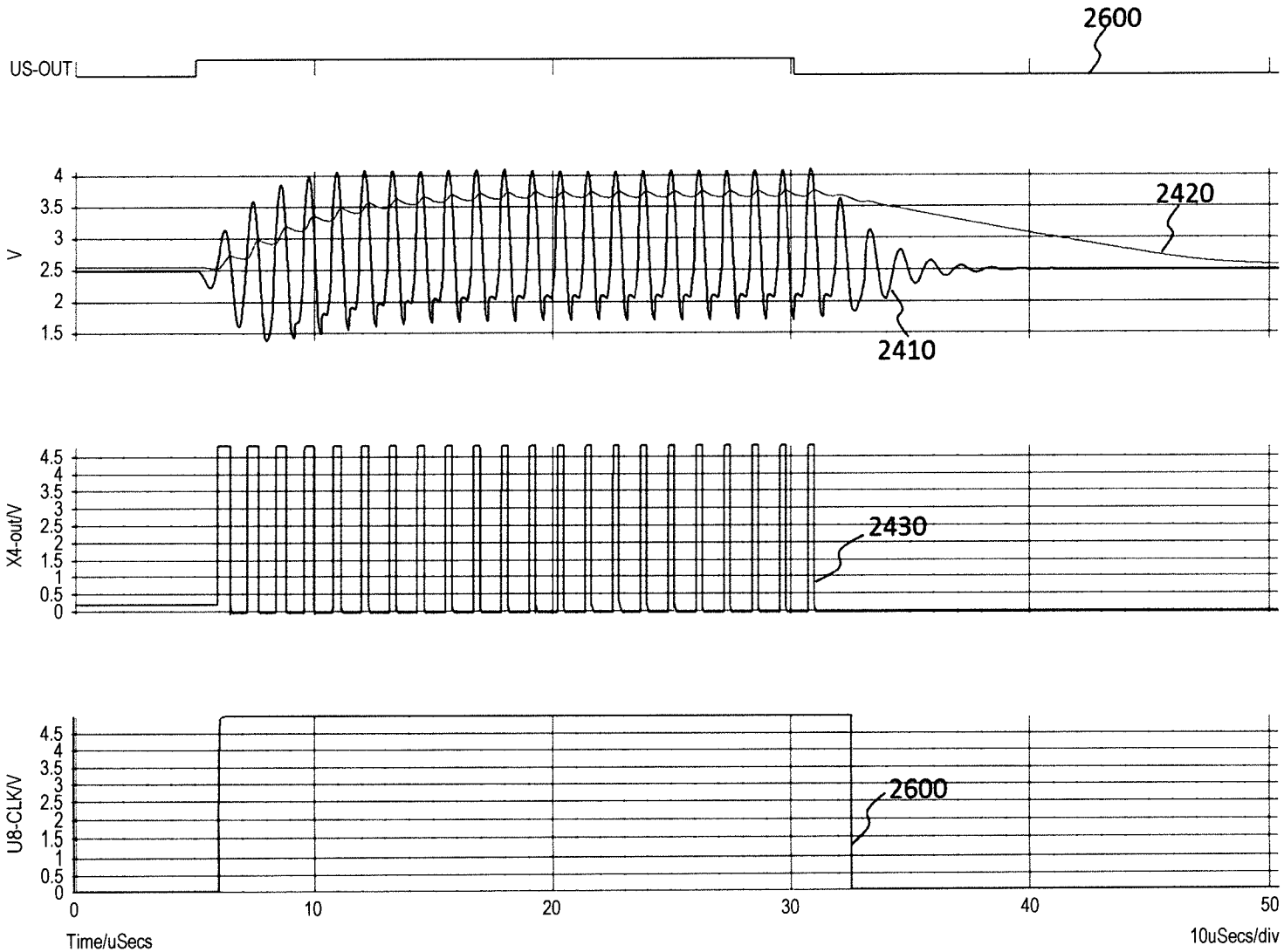
FIGS. 5A to 5D illustrate example signals generated by the subassembly.

FIG. 5A is a plot of voltage against time of an input data signal 2600 on the transmission side data line 260. As can be seen, this is square wave signal which alternates between 0V and 5V. From T0 to T1, the input data signal 2600 is at 0V. From T1 to T2, the input data signal 2600 changes to 5V, before changing back to 0V at T2. In response to this, the transmitter electric circuitry 220 drives the transmitter coil 210 whenever its incoming data line 260 is at 5V, and when it is at 0V its coil is not driven.

When the transmitter coil 210 is driven, a transmission signal is generated in the form of an inductive wave propagating from the coil. That wave then intersects with and is inductively received by the receiver coil 230. In this manner, the inductively received transmission signal induces a voltage potential across the receiver coil. The signal is filtered and amplified with modest gain by the amplifier 241 to generate a filtered and amplified signal. This is shown by line 2410 in FIG. 5B. The level detector 242 then generates an output voltage proportional to a recent amplitude of the amplified signal but scaled to be somewhat lower than the amplitude of the peaks. This voltage changes rapidly in response to changes in the amplitude of the received signal. This voltage signal can be seen as line 2420 in FIG. 5B. In this example, the "recent amplitude" refers to the moving average of the amplitude of the amplified signal for the previous 6 cycles of the carrier frequency, which in this case is at 850 kHz. However, in other examples, the recent amplitude may refer to the amplitude of the amplified signal at a specific point in time prior to the generation of the output voltage Both the filtered and amplified signal 2410 and the recent amplitude signal 2420 are fed into the comparator 243 which drives its output high when the amplified signal 2410 is higher than the recent amplitude signal 2420 and drives its output low at all other times. In this manner, the comparator generates an output pulse corresponding to each peak of the filtered and amplified signal 2410. The resulting output pulse train 2430 can be seen in FIG. 5C. The output pulse train 2430 is fed into the missing pulse detector 244 which compares the output pulse train 2430 to an expected output pulse train and drives the output data line 270 accordingly. The data output signal 2700 generated on the output data line 270 by the missing pulse detector 244 is shown in FIG. 5D. As with the input data signal 2600, the output data signal 2700 is in the form of a square wave which alternates between 0V and 5V.

Considering FIGS. 5A to 5D together, from T0 to T1, both the input data signal 2600 and the output data signal are 0V. At T1, the amplified and filtered signal 2410 begins to oscillate to above the recent amplitude signal 2420 causing the comparator to generate an output pulse train 2430 having a pulse for each peak of the filtered and amplified signal 2410. In response to the output pulse train 2430, the missing pulse detector 244 drives the output data line 270 high so that the output data signal 2700 is 5V. There is very little delay between the change of the input data signal 2600 to 5V and the corresponding change of the output data signal 2700. For example, the delay may be in the region of 1 microsecond. Once the transmit coil 210 drive stops at T2, the amplified and filtered signal 2410 starts to decay and falls below the recent amplitude signal 2420. Consequently, the output pulse train 2430 stops. When the missing pulse detector 244 detects that no pulse is detected when one was expected, it drives the output data line 270 low. Again, there is very little delay between the change of the input data signal 2600 to 0V and the corresponding change of the output data signal 2700. The duration of the delay depends on the frequency of the output pulse but is likely to be in the region of 2.5 microseconds.

Where the link is bi-directional, and uses a bi-directional single wire bus 260, 270 on either side of the inductive circuit, it is beneficial for the link to be able to determine the origin of a transmission in order to drive the two halves of the bus (the probe bus and the collar bus) correctly. This is achieved with a specific algorithm. In particular, when a receiver detects a transmission on its coil it checks the state of its own data line. If it is low, it cannot be transmitting, and therefore must be receiving a transmission from the other transmitter, and should drive its data line to the high state. If its own data line is already high then it must be transmitting and receiving its own transmission, in which case it should not drive its data line.

Both coils are resonated with a temperature stable capacitor and are tuned to the same frequency. These resonant circuits are loaded by eddy current loss in the surrounding metalwork, and this has the effect of lowering the quality factor (Q) of the resonance of each. However, the system does not require a high Q value, and in fact lower Qs are preferable for higher data rates, since the latency is lower. In this example, the system operates at a frequency of about 850 kHz, at which the Q of the resonant circuits is of the order of 10. In other examples, the transmitter and receiver circuits may be tuned to a frequency of from about 500 kHz to about 2 MHz, preferably from about 700 kHz to about 1.2 MHz. The drilling mud may either be oil based, in which case it will be non-conductive, or water based, in which case it could be highly conductive. Conductivity of the drilling mud is potentially a concern, as the magnetic field that links the two coils could generate eddy current in the fluid that could reduce power from the transmitter and absorb the magnetic field, preventing it from reaching the receiver coil. Conductivity in water based drilling mud is mostly ionic conduction caused by dissolved salts, and this conductivity will increase as the temperature increases. Ionic conduction, however, decreases very rapidly as frequency is increased. At frequencies approaching 1 MHz these ions, which typically have an extremely low charge to mass ratio, and even a hot water based mud will not affect this communications link in any significant way. By operating at frequencies approaching 1 Mhz, the wireless communications link requires a very low operating power, with each side of the link consuming of the order of 100 mW under operational conditions. These frequencies also minimise the risk of interference with or by the operation of any resistivity sensors in the vicinity of the wireless communications link.

Data may be transmitted to and from the collar using a communications bus (not shown) running through the tool string. Data may be transmitted to and from the surface from the tool string in a conventional manner, for example via a mud pulse or EM telemetry system that is incorporated into the MWD tool string. There are many different communications buses in use in MWD equipment and the implementation of a wireless link will be different for each. One particularly effective system with which the inductive coupling of the invention may be used is a single wire, bi-directional adaptation of the RS-232 standard but using TTL voltage levels and combining the transmit and receive signals onto one wire. Bus collisions are avoided by protocol and backed up by current limiting hardware. Basic systems operate at 9,600 Baud and 19,200 Baud, and some systems add 38,400 Baud to the list for faster data transfer.

Advantageously, the wireless communications link as described above does not require any knowledge of the protocol in use, nor the Baud rate currently in use by the communications bus. Furthermore, it isn't required to have any understanding of the data that it's relaying between probe assembly and collar. This removes many layers of complexity and provides a system that is to a very large extent protocol and modulation scheme independent.

Because the system operates at a relatively high frequency, which is much higher than the Baud rates involved, and because the Q of the coil arrangement is relatively low, the starting and stopping of a transmission can both be detected within a very short time resulting in a very low latency between data arriving on the bus at the transmitter in the probe and that same data being driven on the bus in the collar. In the particular implementation described above, latency is typically less than 2.5 μs and furthermore, the matching between start and stop latencies is typically of the order of 0.5 μs.

It is usual in communications systems employing resonant circuits to attempt to maximise the Q as this results in a larger amplitude of oscillation which makes the transmitted signal easier to detect. It also has the effect of increasing the time taken to achieve full amplitude at the start of a transmission and the time for the oscillation to decay at the end, and this can result in very high latency. Due to the short required range of this system, a high Q is not required to achieve reasonable amplitude and the Q is deliberately kept low to minimise latency. At the Baud rates employed in this system these latencies of a few microseconds have no impact on the communications system. It could even handle higher Baud rates, say 115 kBaud, if required to do so. As the latency is so low it would be possible to cascade multiple instances of the wireless communications link if such an application ever arose. This means that multiple bus links could use the same wireless communications link simultaneously.

Another advantage of using a relatively low Q is that the receiver and transmitter resonant circuits do not need to be highly tuned and are not highly frequency selective. This, together with the abundance of signal amplitude, makes this system highly tolerant of frequency drift, a great comfort in any system that is required to operate at temperatures as high as 175° C. and as low as −40° C.

Figure 6:
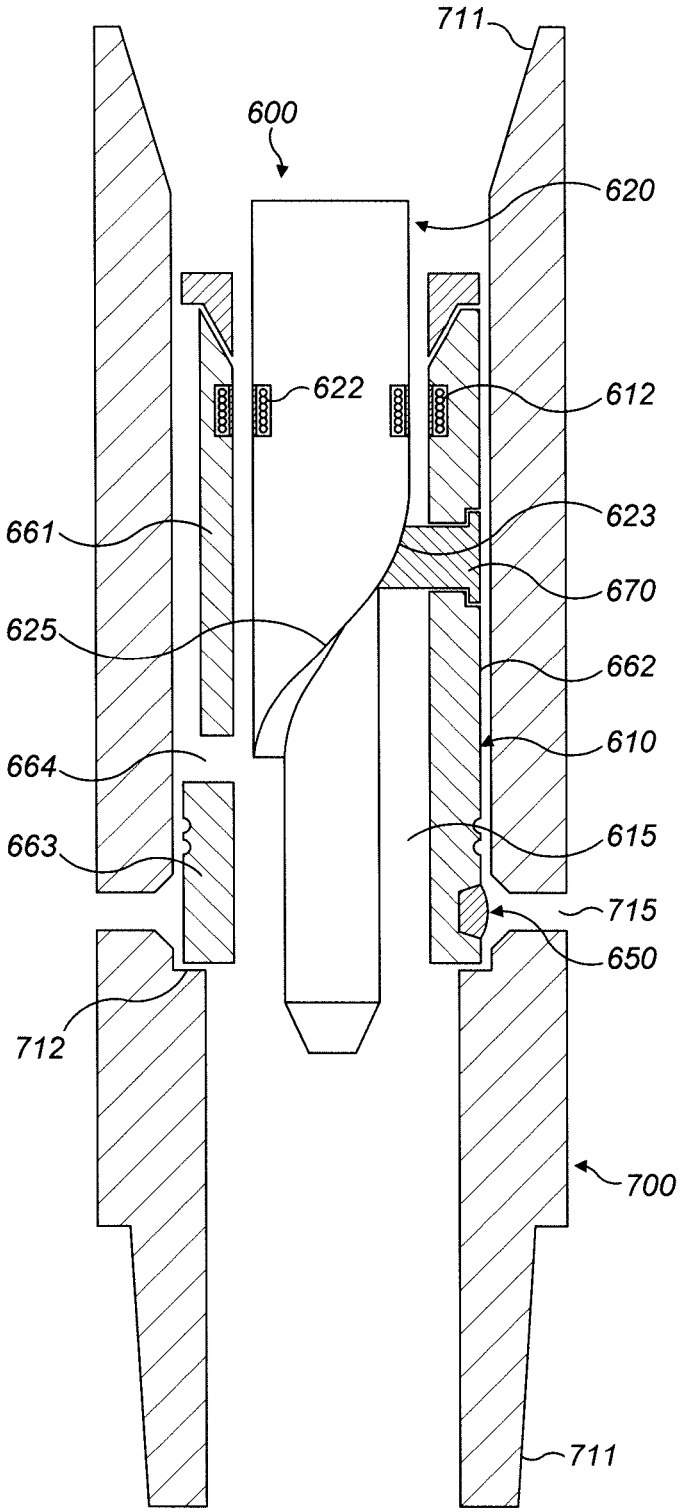
FIG. 6 shows a sectional view of a second embodiment of subassembly for the bottom hole assembly in FIG. 1.
Figure 7:
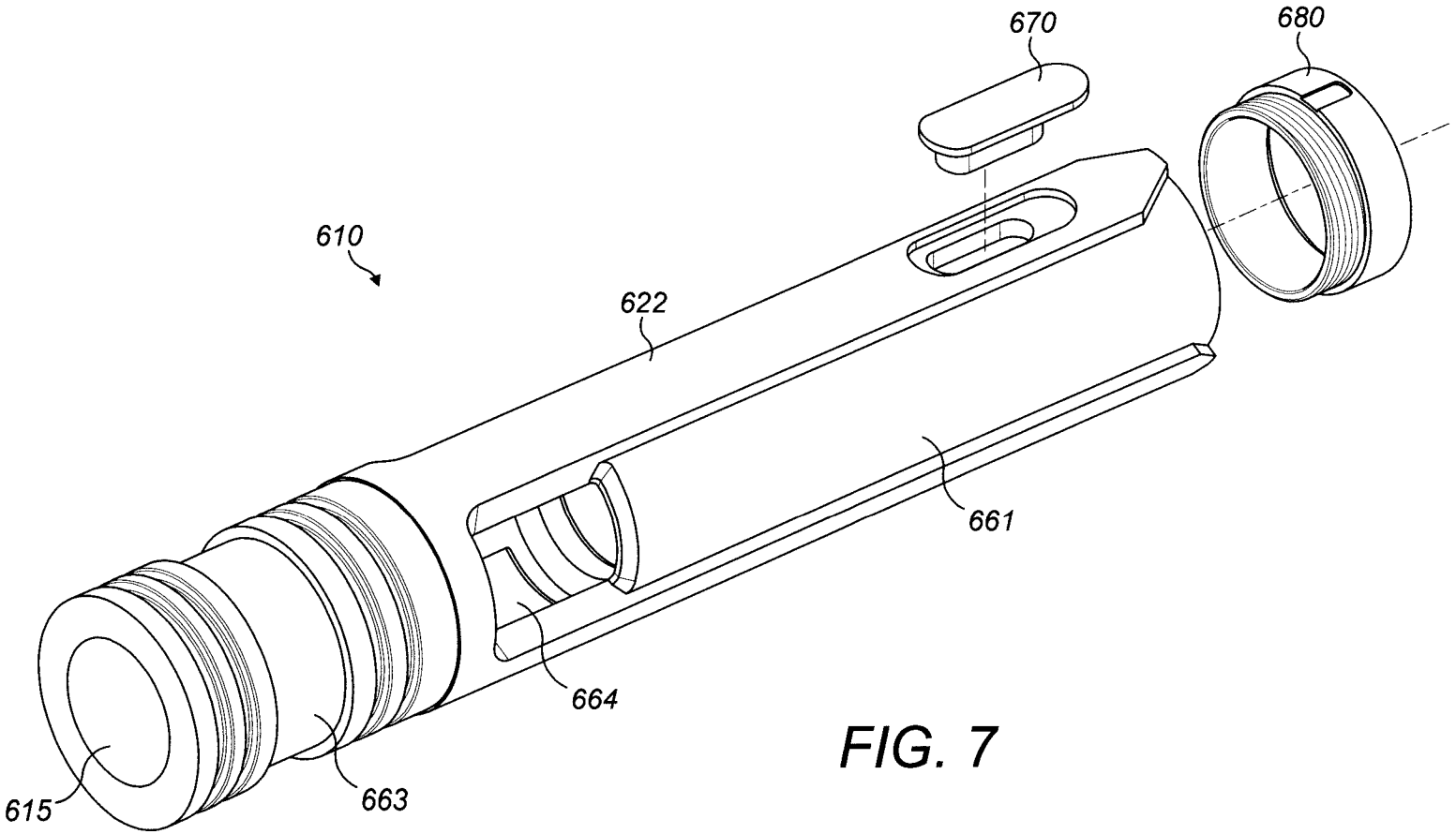
FIG. 7 shows an exploded perspective view of the tubular portion of the subassembly of FIG. 6.

Referring to FIGS. 6 and 7, a second embodiment of subassembly 600 for the bottom hole assembly of FIG. 1 is shown. The subassembly 600 includes a tubular portion in the form of a sleeve 610 having a longitudinal bore 615, and a probe assembly 620 removably located in the longitudinal bore 615. As shown in FIG. 6, the sleeve 610 is arranged for insertion into a collar 700 forming part of the length of the bottom hole assembly. In this example, the sleeve 610 is a mule shoe and the collar is a universal bottom hole orientation (UBHO) sub within which the mule shoe 610 is held. The collar 700 includes threaded connections 711 at its upper and lower ends by which it may be connected to other components in the drill string.

The mule shoe sleeve 610 has a cylindrical portion 661 with a smaller outer diameter than the inner diameter of the collar 700 and has plurality of ribs 662 extending along the length of the cylindrical portion 661 and terminating in an annular portion 663 at the downhole end of the sleeve 610. The ribs 662 engage with the inner surface of the collar 700 and the annular portion 663 abuts against a shoulder 712 in the collar 700. An aperture 664 is provided between the cylindrical portion 661 and the annular portion 663 so that the outside of the cylindrical portion 661 between adjacent ribs 662 is in fluid communication with the bore of the annular portion 663. The sleeve 610 further includes a key 670 extending through the thickness of the sleeve 610 and projecting into the bore 615 defined by the cylindrical portion 661. A replaceable wear ring 680 is screwed onto the upstring end of the sleeve 610.

The probe assembly 620 is substantially the same as the probe assembly of the first embodiment. However, the probe assembly 620 of the second embodiment further includes a longitudinally extending slot 623 on its outer surface for receiving the key 670 and has an angled guide surface 625 which leads to the entrance of the slot 623.

Before the collar is connected to the drill string, the sleeve 610 is axially inserted into the bore of the collar 700 so that the annular portion 663 abuts against the shoulder 712. The sleeve 610 is then held in position within the collar 700 by setscrews (not shown) that extend through ports 713 in the collar 700 to clamp down on the sleeve 610. Once the sleeve 610 is in position, the probe assembly 620 is inserted into the bore 615 of the sleeve 610 until the key 670 engages with the slot 623 on the outer surface of the probe assembly 620. If required, rotational position of the probe assembly 620 is corrected during insertion be the engagement of the key 670 with the guide surface 625 on the probe assembly 620. Thus, as with the first embodiment, the probe assembly 620 is suspended within the tubular portion 610 such that rotation and further downward movement of the probe assembly 620 is prevented. As with the first embodiment, the probe assembly 620 may be easily retrieved from above.

When the probe assembly 620 is located within the bore 615, an annular flow channel 640 is defined in the section of the bore 615 between the inner surface of the sleeve 610 and the probe assembly 620 to allow the flow of drilling mud through the sleeve 610 around the probe assembly 620. Drilling mud may also pass along the outside of the cylindrical portion 661 between adjacent ribs 662 and through the bore in the annular portion 663 via the aperture 664. A sensor (not shown) is attached to the lower end of the sleeve 610 and may be in fluid communication with the wellbore to allow the sensor to obtain measurements directly from the wellbore. The sensor is connected to the tubular portion coil 612 via a sensor data line (not shown). The measurements obtained from the sensor are communicated to the probe assembly 620 using a wireless communications link in the same manner as described above in relation to the first embodiment.

Figure 8A:
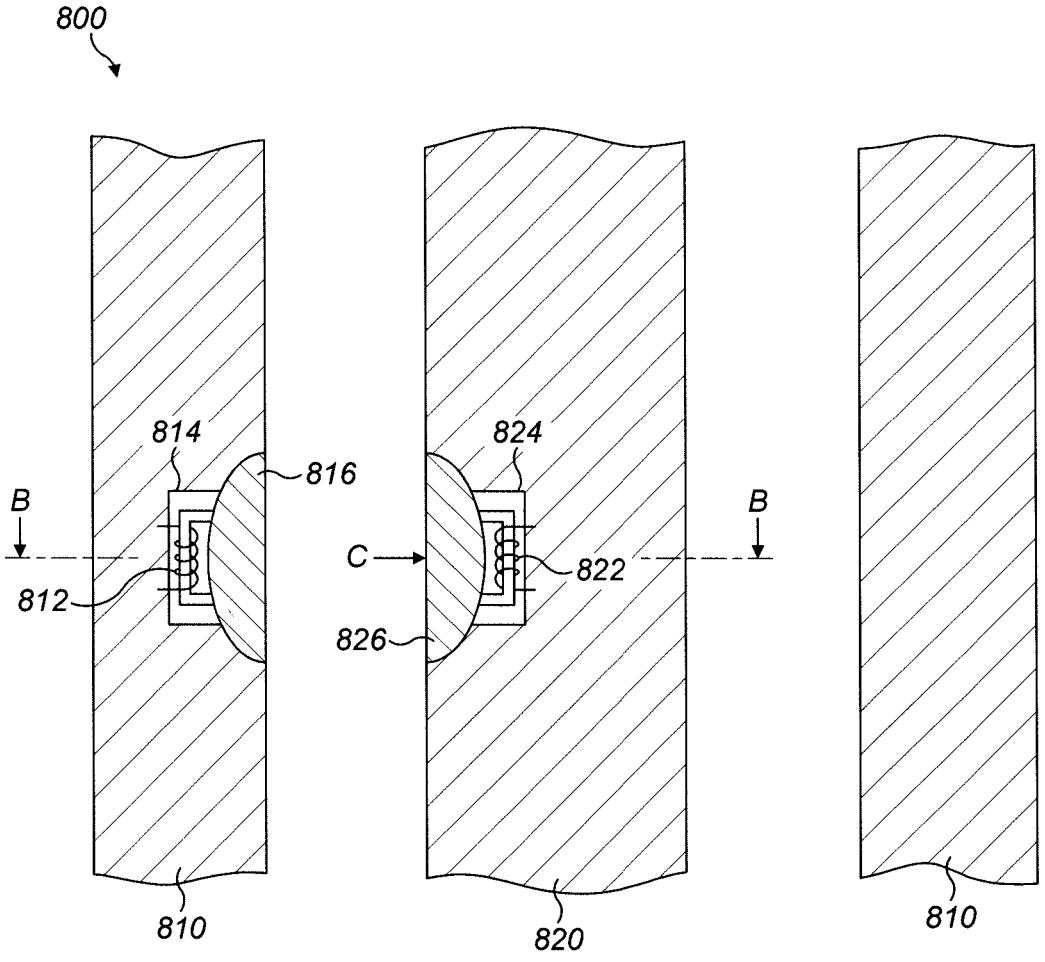
FIG. 8A shows a sectional view of a third embodiment of subassembly for the bottom hole assembly of FIG. 1.
Figure 8B:
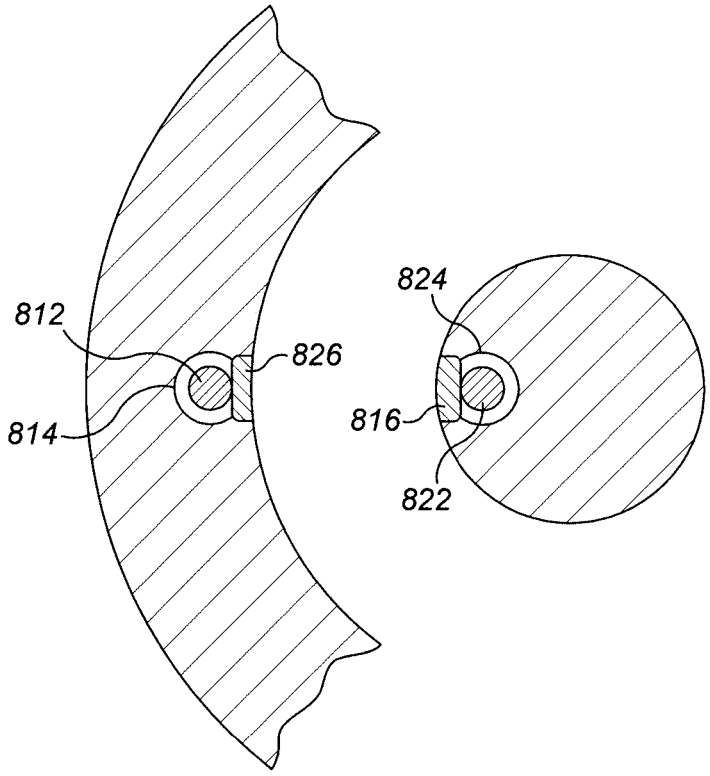
FIG. 8B shows a transverse cross-sectional view of the subassembly of FIG. 8A taken through line B-B.
Figure 8C:
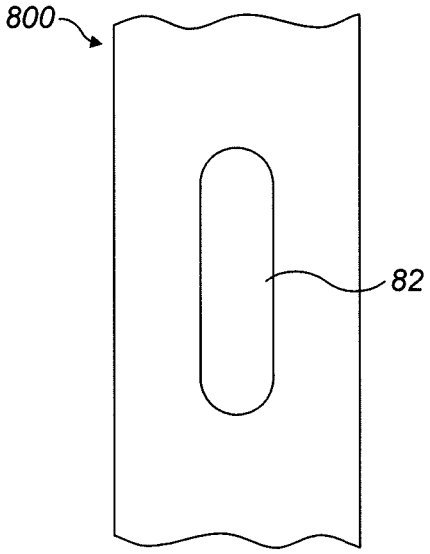
FIG. 8C shows a side view of the probe assembly of the subassembly of FIG. 8A in the direction of arrow C.

Referring to FIGS. 8A to 8C, a third embodiment of subassembly 800 for the bottom hole assembly of FIG. 1 is shown. The subassembly 800 of the third embodiment is similar in construction and operation to first embodiment of subassembly 100, and where the same features are present, like reference numerals have been used. However, in the third embodiment of subassembly 800, the tubular portion coil 812 is wound around a core located within a recess 814 formed on the inner surface of the tubular collar 810 only on one side of the tubular collar 810, and the probe coil 822 is wound around a core located within a recess 824 formed only on one side of outer surface of the probe assembly 810. With this configuration, the magnetic axes of the tubular portion coil 812 and the probe coil 822 are parallel but offset from each other. As with the first embodiment of subassembly 100, a non-metallic cover 816, 826 is provided over the opening of each of the recesses 814, 824. Due to the shape of the recesses 814, 824, it may be easier to form a seal using the covers 816, 826 in comparison to the annular seals of the first embodiment.

The specific embodiments and examples described above illustrate but do not limit the invention. It is to be understood that other embodiments of the invention may be made and the specific embodiments and examples described herein are not exhaustive.

The invention claimed is:

1. A subassembly for a wellbore, the subassembly comprising:

a tubular portion having a wall for supporting one or more sensors and an inner surface defining a longitudinal bore;

a probe assembly removably located in the bore and positioned such that a flow channel for fluid is defined between the inner surface of the tubular portion and the probe assembly; and a wireless communications link for data transfer between the probe assembly and a sensor supported by the tubular portion, the wireless communications link including a probe coil forming part of the probe assembly and connectable to a probe data line, and a tubular portion coil forming part of the tubular portion and connectable to a sensor data line, wherein the probe coil and the tubular portion coil are positioned such that an inductive coupling is formed across the flow channel between the probe coil and the tubular portion coil to allow data transfer between the probe data line and the sensor data line using the inductive coupling, wherein the tubular portion coil is connected to transmitter electric circuitry configured to operate the tubular portion coil as a transmitter coil, and wherein the probe coil is connected to receiver electric circuitry configured to operate the probe coil as a receiver coil;

wherein the probe coil is connected to transmitter electric circuitry configured to operate the probe coil as a transmitter coil, and wherein the tubular portion coil is connected to receiver electric circuitry configured to operate the tubular portion coil as a receiver coil; and wherein the receiver electric circuitry is configured to amplify and filter a remote transmission signal inductively received by the receiver coil to generate an amplified and filtered signal, generate a voltage signal proportional to a recent amplitude of the amplified signal, and compare the amplified and filtered signal to the voltage signal to determine if the remote transmission signal has recently ended.

2. The subassembly according to claim 1, wherein the receiver electric circuitry is further configured to generate an output pulse train having an output pulse for each peak of the amplified and filtered signal that exceeds the voltage signal and to drive an output data line according to the output pulse train.

3. The subassembly according to claim 2, wherein the receiver electric circuitry comprises a missing pulse detector configured to compare the output pulse train to an expected output pulse train and to indicate that the remote transmission signal has recently ended if one or more expected output pulses are missing from the output pulse train.

4. The subassembly according to claim 3 wherein the receiver electric circuitry is configured to drive the output data line high when the output pulse train substantially corresponds to the expected output pulse train and to drive the output data line low when the missing pulse detector indicates that the remote transmission signal has recently ended.

5. The subassembly according to claim, 1 wherein the transmitter electric circuitry and the receiver electric circuitry of the wireless communications link are configured to transfer data in real time.

6. The subassembly according to claim 1, wherein the tubular portion comprises a recess on its inner surface in which the tubular portion coil is located, and the probe assembly comprises a recess on its outer surface in which the probe coil is located.

7. The subassembly according to claim 1, wherein the probe coil and the tubular portion coil are each independently powered by a battery or a downhole power generator.

8. The subassembly according to claim 1, wherein the probe coil and the tubular portion coil are both tuned to a frequency of from about 500 kHz to about 2 MHz.

9. The subassembly according to claim 8, wherein the probe coil and the tubular portion coil are both tuned to a frequency of from about 700 kHz to about 1.2 MHz.

10. The subassembly according to claim 9, wherein the probe coil and the tubular portion coil are both tuned to a frequency of about 850 kHz.

11. The subassembly according to claim 1, further comprising one or more sensors mounted in or on the wall of the tubular portion and one or more sensor data lines connected to the one or more sensors, wherein the one or more sensors are connected to the tubular portion coil by the one or more sensor data lines such that data may be transferred between the probe assembly and each of the one or more external sensors using the wireless communications link.

12. A subassembly for a wellbore, the subassembly comprising:

a tubular portion having a wall for supporting one or more sensors and an inner surface defining a longitudinal bore;

a probe assembly removably located in the bore and positioned such that a flow channel for fluid is defined between the inner surface of the tubular portion and the probe assembly; and a wireless communications link for data transfer between the probe assembly and a sensor supported by the tubular portion, the wireless communications link including a probe coil forming part of the probe assembly and connectable to a probe data line, and a tubular portion coil forming part of the tubular portion and connectable to a sensor data line, wherein the probe coil and the tubular portion coil are positioned such that an inductive coupling is formed across the flow channel between the probe coil and the tubular portion coil to allow data transfer between the probe data line and the sensor data line using the inductive coupling;

wherein one or both of the probe coil and the tubular portion coil is spaced from the edges of its respective recess by a clearance of from greater than about 0.05 inches (1.25 mm).

13. The subassembly according to claim 12, wherein the recess of the tubular portion comprises a radial groove on the inner surface of the tubular portion in which the tubular portion coil is wound and wherein the recess of the probe assembly comprises a radial groove on the outer surface of the probe assembly in which the probe coil is wound.

14. The subassembly according to claim 12, wherein one or both of the probe coil and the tubular portion coil is spaced from the edges of its respective recess by a clearance of from greater than about 0.1 inches (2.5 mm).

15. A subassembly for a wellbore, the subassembly comprising:

a tubular portion having a wall for supporting one or more sensors and an inner surface defining a longitudinal bore;

a probe assembly removably located in the bore and positioned such that a flow channel for fluid is defined between the inner surface of the tubular portion and the probe assembly; and a wireless communications link for data transfer between the probe assembly and a sensor supported by the tubular portion, the wireless communications link including a probe coil forming part of the probe assembly and connectable to a probe data line, and a tubular portion coil forming part of the tubular portion and connectable to a sensor data line, wherein the probe coil and the tubular portion coil are positioned such that an inductive coupling is formed across the flow channel between the probe coil and the tubular portion coil to allow data transfer between the probe data line and the sensor data line using the inductive coupling;

wherein the inductive circuit formed by the tubular portion coil and the probe coil has a quality factor (Q) of from about 6 to about 10.

16. A method of transferring data in a wellbore, the method comprising the steps of:

providing a subassembly comprising:

a tubular portion having a wall for supporting one or more sensors and an inner surface defining a longitudinal bore;

a probe assembly removably located in the bore and positioned such that a flow channel for fluid is defined between the inner surface of the tubular portion and the probe assembly; and a wireless communications link for data transfer between the probe assembly and a sensor supported by the tubular portion, the wireless communications link including a probe coil wound around the probe assembly and connected to a probe data line and a tubular portion coil wound around the inner surface of the tubular portion and connected to a sensor data line;

forming an inductive circuit between the probe coil and the tubular portion coil;

transmitting a data signal across the flow channel by driving one of the probe coil and the tubular portion coil as a transmitter coil; and inductively receiving the data signal by operating the other one of the probe coil and the tubular portion coil as a receiver coil, wherein the step of inductively receiving the data signal is carried out by:

detecting an inductively received remote transmission signal using the receiver coil;

amplifying and filtering the remote transmission signal to generate an amplified and filtered signal;

generating a voltage signal proportional to a recent amplitude of the amplified and filtered signal; and determining if the remote transmission signal has recently ended by comparing the amplified and filtered signal to the voltage signal.

17. The method according to claim 16, further comprising the steps of:

generating an output pulse train having an output pulse for each peak of the amplified and filtered signal that exceeds the voltage signal; and driving an output data line to which the receiver coil is connected, according to the output pulse train.

18. The method according to claim 17, wherein the step of determining if the remote transmission signal has recently ended is carried out by comparing the output pulse train to an expected output pulse train and indicating that the remote transmission signal has recently ended if one or more expected output pulses are missing from the output pulse train; wherein the method further comprises the step of driving the data line low when the missing pulse detector indicates that the transmitter coil has stopped transmitting.

19. A subassembly for a wellbore, the subassembly comprising:

a tubular portion having a wall for supporting one or more sensors and an inner surface defining a longitudinal bore; and a probe assembly removably located in the bore and positioned such that a flow channel for fluid is defined between the inner surface of the tubular portion and the probe assembly;

wherein:

the probe assembly comprises a probe coil, and the tubular portion comprises a tubular portion coil arranged to form an inductive coupling with the probe coil across the flow channel; and wherein:

the probe assembly further comprises probe transmitter electric circuitry connected to the probe coil and configured to send a drive signal to the probe coil; and the tubular portion further comprises tubular portion receiver electric circuitry connected to the tubular portion coil and configured to process a signal inductively received by the tubular portion coil from the probe coil, and generate an output data signal corresponding to the drive signal generated by the probe transmitter electric circuitry, such that a wireless communication link can be formed between the probe assembly and the tubular portion, wherein:

the tubular portion receiver electric circuitry is connectable to a sensor data line and configured to check the status of the sensor data line in response to receiving a signal from the tubular portion coil; and wherein:

if the receiver electric circuitry does not identify a signal on the sensor data line, the receiver electric circuitry is configured to drive the sensor data line based on the signal received from the tubular portion coil.

20. The subassembly according to claim 19, wherein the output data signal is a replication of the drive signal with a delay of less than about 5 microseconds.

21. The subassembly according to claim 19, wherein the output data signal and the drive signal are square wave signals.

22. The subassembly according to claim 19, wherein the output data signal can be produced without reference to a communications Baud rate and/or protocol.

23. A subassembly for a wellbore, the subassembly comprising:

a tubular portion having a wall for supporting one or more sensors and an inner surface defining a longitudinal bore; and a probe assembly removably located in the bore and positioned such that a flow channel for fluid is defined between the inner surface of the tubular portion and the probe assembly;

wherein:

the probe assembly comprises a probe coil, and the tubular portion comprises a tubular portion coil arranged to form an inductive coupling with the probe coil across the flow channel; and wherein:

the tubular portion further comprises tubular portion transmitter electric circuitry connected to the tubular portion coil and configured to send a drive signal to the tubular portion coil; and the probe assembly further comprises probe receiver electric circuitry connected to the probe coil and configured to process a signal inductively received by the probe coil from the tubular portion coil, and generate an output data signal corresponding to the drive signal generated by the tubular portion transmitter electric circuitry, such that a wireless communication link can be formed between the probe assembly and the tubular portion wherein:

the probe receiver electric circuitry is connectable to a probe data line and configured to check the status of the probe data line in response to detecting a transmission on the probe coil; and wherein:

if the receiver electric circuitry does not identify a signal on the sensor data line, the receiver electric circuitry is configured to drive the probe data line based on the signal received from the probe coil.

* * * * *